US010095157B2

(12) United States Patent
Suzuki

(10) Patent No.: US 10,095,157 B2
(45) Date of Patent: Oct. 9, 2018

(54) SEMICONDUCTIVE ROLLER

(71) Applicant: SUMITOMO RUBBER INDUSTRIES, LTD., Kobe-shi, Hyogo (JP)

(72) Inventor: Daijiro Suzuki, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/782,337

(22) Filed: Oct. 12, 2017

(65) Prior Publication Data

US 2018/0136580 A1 May 17, 2018

(30) Foreign Application Priority Data

Nov. 11, 2016 (JP) ..... 2016-220769

(51) Int. Cl.
*G03G 15/08* (2006.01)

(52) U.S. Cl.
CPC . *G03G 15/0818* (2013.01); *G03G 2215/0634* (2013.01)

(58) Field of Classification Search
None
See application file for complete search history.

(56) References Cited

U.S. PATENT DOCUMENTS 4,777,119 A * 10/1988 Brault ..... G03F 7/322 430/296
5,285,248 A * 2/1994 Menjo ..... G03G 11/00 219/216
5,537,194 A * 7/1996 Henry ..... G03G 15/162 399/237
5,582,949 A * 12/1996 Bigelow ..... G03G 5/10 427/74
5,585,905 A * 12/1996 Mammino ..... G03G 15/162 399/296
5,965,314 A * 10/1999 Herman ..... G03G 15/162 399/308
6,411,793 B1 * 6/2002 Badesha ..... G03G 15/161 399/237

(Continued)

FOREIGN PATENT DOCUMENTS

JP 10250252 A * 9/1998
JP 2013-129747 A 7/2013

*Primary Examiner* — Sevan A Aydin
(74) *Attorney, Agent, or Firm* — Birch, Stewart, Kolasch & Birch, LLP

(57) ABSTRACT

A semiconductive roller is provided which includes a roller body including a tubular inner layer of an inner layer elastic material containing a softener, and an outer layer of an outer layer elastic material provided on an outer periphery of the inner layer. The outer layer elastic material has a swelling percentage of not higher than 1% as measured when the outer layer elastic material is immersed in the softener at 100° C. for 24 hours. Thus, the semiconductive roller has proper flexibility to be substantially free from imaging failures such as white voids, image density reduction and fogging, and is less liable to cause the contamination of a photoreceptor body and the like and the associated defective image formation which may otherwise occur due to the bleeding of the softener.

11 Claims, 1 Drawing Sheet

(56) References Cited

U.S. PATENT DOCUMENTS

| | | | | |
|---|---|---|---|---|
| 7,302,216 | B2 * | 11/2007 | Lior | G03G 15/161 399/302 |
| 2002/0045115 | A1 * | 4/2002 | Carmichael | G03G 5/047 430/58.8 |
| 2007/0110994 | A1 * | 5/2007 | Pickering | G03G 15/2057 428/323 |
| 2008/0107451 | A1 * | 5/2008 | Nukada | G03G 15/0233 399/176 |
| 2009/0026607 | A1 * | 1/2009 | Huebner | H01L 21/563 257/737 |

* cited by examiner

SEMICONDUCTIVE ROLLER

CROSS-REFERENCE TO RELATED APPLICATIONS

This application corresponds to Japanese Patent Application No. 2016-220769 filed in the Japan Patent Office on Nov. 11, 2016, the disclosure of which is incorporated herein by reference in its entirety.

TECHNICAL FIELD

The present invention relates to a semiconductive roller.

BACKGROUND ART

A semiconductive roller including a nonporous single-layer roller body produced, for example, by blending an ion conductive rubber with a diene rubber to prepare a semiconductive rubber composition, forming the rubber composition into a tubular body and crosslinking the tubular body is advantageously used as a developing roller to be incorporated in an electrophotographic image forming apparatus (Patent Document 1: JP2013-129747A).

SUMMARY OF INVENTION

However, the roller body of the conventional semiconductive roller described above has a relatively high hardness. Therefore, the semiconductive roller often fails to provide sufficient abutment nip with respect to a photoreceptor body at the initial stage of image formation, so that white voids are liable to occur in edge portions of an image.

During repeated image formation, the semiconductive roller is liable to apply a greater stress to toner to thereby reduce the service life of the toner. This may result in reduction in the image density of a formed image and adhesion of the toner to a margin of the image (so-called fogging).

For prevention of such imaging failures, the roller body is required to have higher flexibility.

It is conceivable to add a softener such as oil to the rubber composition for the roller body to impart the roller body with flexibility.

However, the softener is liable to bleed on an outer peripheral surface of the roller body. If the semiconductive roller including the softener-containing roller body is used as a developing roller to be kept in constant contact with the photoreceptor body, for example, the softener bleeding on the outer peripheral surface of the roller body contaminates the photoreceptor body and the like, resulting in defective image formation.

It is an object of the present invention to provide a semiconductive roller which has proper flexibility to be substantially free from imaging failures such as the white voids, the image density reduction and the fogging, and is less liable to cause the contamination of the photoreceptor body and the like and the associated defective image formation which may otherwise occur due to the bleeding of the softener.

According to the present invention, there is provided a semiconductive roller including a roller body which includes a tubular inner layer of an inner layer elastic material containing a softener, and an outer layer of an outer layer elastic material provided on an outer periphery of the inner layer, the outer layer elastic material having a swelling percentage of not higher than 1% as measured when the outer layer elastic material is immersed in the softener at 100° C. for 24 hours.

Advantageous Effects of Invention

The semiconductive roller according to the present invention has proper flexibility to be substantially free from imaging failures such as the white voids, the image density reduction and the fogging, and is less liable to cause the contamination of the photoreceptor body and the like and the associated defective image formation which may otherwise occur due to the bleeding of the softener.

DESCRIPTION OF EMBODIMENTS

A semiconductive roller according to the present invention includes a roller body which includes a tubular inner layer of an inner layer elastic material containing a softener, and an outer layer of an outer layer elastic material provided on an outer periphery of the inner layer. The outer layer elastic material has a swelling percentage of not higher than 1% as measured when the outer layer elastic material is immersed in the softener at 100° C. for 24 hours.

According to the present invention, the inner layer elastic material contains the softener, whereby the flexibility of the roller body is totally improved. The outer layer of the outer layer elastic material having a softener swelling percentage of not higher than 1% and hence less permeable to the softener is provided on the outer periphery of the inner layer. This substantially prevents the softener from permeating through the outer layer and bleeding on the surface of the outer layer, i.e., on the outer peripheral surface of the roller body.

According to the present invention, therefore, the semiconductive roller has proper flexibility to be substantially free from imaging failures such as the white voids, the image density reduction and the fogging, and is less liable to cause the contamination of the photoreceptor body and the like and the associated defective image formation which may otherwise occur due to the bleeding of the softener.

Figure 1A:
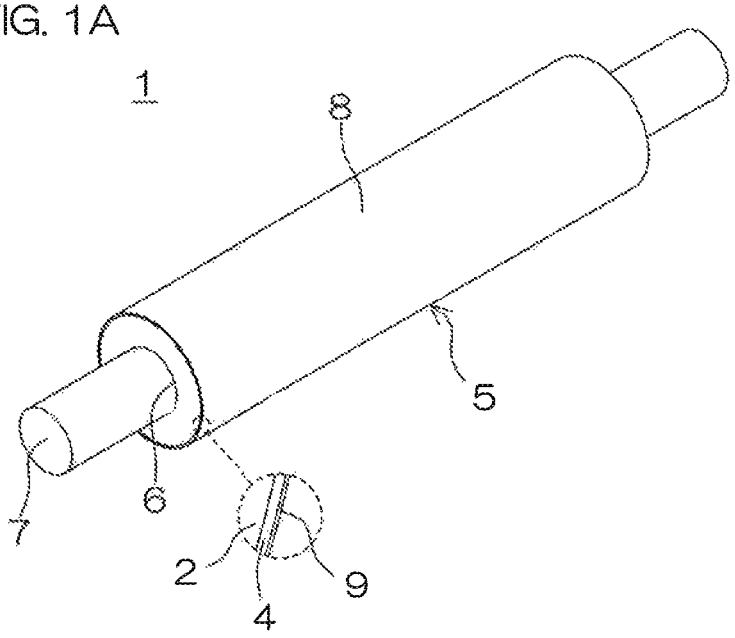
FIG. 1A is a perspective view showing the overall appearance of a semiconductive roller according to an embodiment of the present invention.
Figure 1B:
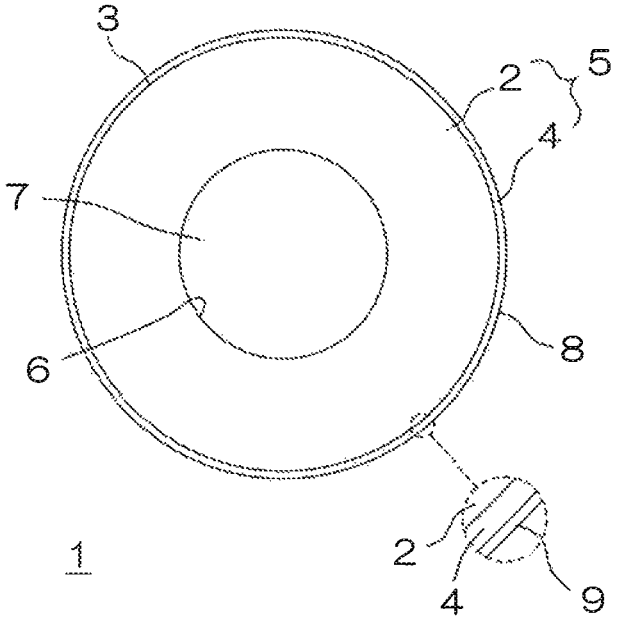
FIG. 1B is an end view of the semiconductive roller according to the embodiment.

FIG. 1A is a perspective view showing the overall appearance of a semiconductive roller according to an embodiment of the present invention. FIG. 1B is an end view of the semiconductive roller according to the embodiment.

Referring to FIGS. 1A and 1B, the semiconductive roller 1 according to this embodiment includes a roller body 5 which has a double layer structure including a tubular inner layer 2 of an inner layer elastic material containing a softener, and an outer layer 4 of an outer layer elastic material provided on an outer peripheral surface 3 of the inner layer 2.

A shaft 7 is inserted through and fixed to a center through-hole 6 of the inner layer 2.

The shaft 7 is a unitary member made of a metal such as aluminum, an aluminum alloy or a stainless steel.

The shaft 7 is electrically connected to and mechanically fixed to the roller body 5, for example, via an electrically conductive adhesive agent. Alternatively, a shaft having an outer diameter that is greater than the inner diameter of the through-hole 6 is used as the shaft 7, and press-inserted into the through-hole 6 to be electrically connected to and mechanically fixed to the roller body 5.

The roller body 5 has an oxide film 9 formed in a surface of the outer layer 4, i.e., in an outer peripheral surface 8 thereof, as shown in FIGS. 1A and 1B on an enlarged scale.

The oxide film 9 thus formed functions as a dielectric layer to reduce the dielectric dissipation factor of the semiconductive roller 1. Further, the oxide film 9 serves as a lower friction layer which advantageously suppresses the adhesion of the toner.

In addition, the oxide film 9 can be easily formed through oxidation of a rubber present in the outer peripheral surface 8, for example, by irradiating the outer peripheral surface 8 with ultraviolet radiation in an oxidizing atmosphere. This suppresses the reduction in the productivity of the semiconductive roller 1 and the increase in the production costs of the semiconductive roller 1.

The inner layer 2 and the outer layer 4 each preferably have a nonporous single-layer structure for simplification of the structure thereof and for improvement of the durability and the like thereof.

The term "single-layer structure" of the outer layer 4 means that the outer layer 4 includes a single layer of the outer layer elastic material, and the term "double-layer structure" of the roller body 5 means that the roller body 5 includes two layers (i.e., the inner layer 2 and the outer layer 4) each made of the elastic material. In either case, the oxide film 9 formed by the irradiation with the ultraviolet radiation or the like is not counted.

As described above, the inner layer elastic material for the inner layer 2 contains the softener and, therefore, has moderate flexibility. In addition, the inner layer elastic material is required to be semiconductive to impart the roller body 5 with semiconductivity to control the roller resistance of the semiconductive roller 1 within a roller resistance range that is suitable for a developing roller or the like.

The inner layer elastic material is a crosslinked product of a rubber composition for the inner layer 2 (inner layer rubber composition) which contains a rubber, a crosslinking component, the softener and, as required, additives.

On the other hand, the outer layer elastic material for the outer layer 4 is required to have a swelling percentage of not higher than 1% as measured when the outer layer elastic material is immersed in the softener to be contained in the inner layer 2 at 100° C. for 24 hours as described above.

That is, if the swelling percentage of the outer layer elastic material is higher than 1%, the resulting outer layer 4 is permeable to the softener. Therefore, the softener is liable to permeate through the outer layer 4 to bleed on the surface of the outer layer 4, i.e., on the outer peripheral surface 8 of the roller body 5, to thereby contaminate the photoreceptor body and the like.

Where the outer layer 4 is made of the outer layer elastic material having a softener swelling percentage of not higher than 1, in contrast, the outer layer 4 suppresses the permeation of the softener and the bleeding of the softener on the outer peripheral surface 8, thereby advantageously suppressing the contamination of the photoreceptor body and the like.

For further improvement of this effect, the swelling percentage is preferably not higher than 0.65% within the aforementioned range.

The lower limit of the swelling percentage is not particularly specified. For the softener permeation suppressing effect, the swelling percentage may be 0%.

Where the swelling percentage is not higher than 1%, particularly not higher than 0.65%, the effect can be provided to some extent. In consideration of easy selection and easy preparation of the outer layer elastic material for formation of the outer layer 4 having moderate flexibility and semiconductivity, the swelling percentage is preferably not lower than about 0.2% within the aforementioned range.

Where the outer layer elastic material is a crosslinked product of an outer layer rubber composition, for example, the softener swelling percentage of the outer layer elastic material is controlled within the aforementioned range by properly selecting the type and the grade of a rubber for the outer layer rubber composition according to the type and the grade of the softener to be contained in the inner layer 2. Where two or more types of rubbers are used in combination for the outer layer rubber composition, the softener swelling percentage of the outer layer elastic material is controlled by properly selecting the types and the grades of the rubbers and adjusting the blending proportion of the rubbers.

The swelling percentage is determined by performing an immersion test in the softener to be contained in the inner layer 2 at an immersion temperature of 100° C. for an immersion period of 24 hours in conformity with "Immersion test" specified in Japanese Industrial Standards K6258: 2003 "Rubber, vulcanized or thermoplastic—Determination of the effect of liquids" and calculating a volume change percentage $\Delta V_{100}$ (%) from the following expression (1) based on the results of the immersion test:

Wherein $$\Delta V_{100} = \frac{(m_3 - m_4 + m_5) - (m_1 - m_2 + m_5)}{(m_1 - m_2 + m_5)} \times 100 \quad (1)$$

$\Delta V_{100}$: Swelling percentage (=volume change percentage) (%)

$m_1$: The mass (mg) of a test piece in air before the immersion $m_2$: The mass (mg) of the test piece in water before the immersion *1

$m_3$: The mass (mg) of the test piece in air after the immersion $m_4$: The mass (mg) of the test piece in water after the immersion *1

$m_5$: The mass (mg) of a weight in water

*1: Where the weight is used, the mass of the weight is added to the mass of the test piece.

The outer layer elastic material for the outer layer 4 is also required to be semiconductive to impart the roller body 5 with semiconductivity to control the roller resistance of the semiconductive roller 1 within the roller resistance range suitable for the developing roller or the like.

Further, it is preferred that the outer layer elastic material is substantially free from the softener (or excludes the softener) which may otherwise bleed on the surface of the outer layer 4, i.e., on the outer peripheral surface 8 of the roller body 5, to contaminate the photoreceptor body and the like.

The outer layer elastic material is a crosslinked product of a rubber composition for the outer layer 4 (outer layer rubber composition) which contains a rubber, a crosslinking component and, as required, additives.

For production of the roller body 5 shown in FIGS. 1A and 1B by using the inner layer rubber composition and the outer layer rubber composition, these rubber compositions are fed into a double-layer extruder to be coextruded into a double-layered tubular body, which is in turn entirely crosslinked. Thus, the inner layer 2 and the outer layer 4 are formed. As required, the outer peripheral surface 8 is polished, and formed with the oxide film 9 by irradiation of the outer peripheral surface 8 with ultraviolet radiation or the like.

Alternatively, the inner layer rubber composition is extruded into a tubular body, which is in turn crosslinked to form the inner layer 2. Then, a sheet of the outer layer rubber composition is wrapped around the inner layer 2, and the resulting product is formed into a tubular body, for example, by a press forming method or the like, whereby the inner layer 2 and the outer layer 4 are crosslinked and combined together. As required, the outer peripheral surface 8 is polished, and formed with the oxide film 9.

Thus, the roller body 5 is produced.

<<Inner Layer Rubber Composition>>

<Rubber>

A rubber which is different in solubility parameter (SP) value from the softener by a difference of less than 1 to be thereby highly compatible with the softener is preferably used for the inner layer rubber composition.

Thus, the softener is substantially prevented from leaching out of the inner layer 2 and permeating through the outer layer 4 to bleed on the outer peripheral surface 8 of the roller body 5. This further advantageously suppresses the contamination of the photoreceptor body and the like with the softener.

Where a petroleum-derived oil is used as the softener, for example, the rubber satisfying the aforementioned conditions is a nonpolar rubber such as butadiene rubber (BR), isoprene rubber (IR) and ethylene propylene diene rubber (EPDM), which may be used alone or in combination.

(BR)

Usable as the BR are various crosslinkable BRs each having a polybutadiene structure in a molecule thereof.

Particularly, a higher cis-content BR having a cis-1,4 bond content of 95% or higher and excellent rubber characteristic properties in a wider temperature range from a lower temperature to a higher temperature is preferred.

The BRs include those of an oil-extension type having flexibility controlled by addition of an extension oil (softener), and those of a non-oil-extension type containing no extension oil. Either type of the BRs is usable.

These BRs may be used alone or in combination.

(IR)

Usable as the IR are various IRs each synthesized as having a natural rubber structure.

The IRs include those of an oil-extension type having flexibility controlled by addition of an extension oil (softener), and those of a non-oil-extension type containing no extension oil. Either type of the IRs is usable.

These IRs may be used alone or in combination.

(EPDM)

Usable as the EPDM are various copolymers prepared by copolymerizing ethylene, propylene and a diene. Examples of the diene include ethylidene norbornene (ENB) and dicyclopentadiene (DCPD).

The EPDMs include those of an oil-extension type having flexibility controlled by addition of an extension oil (softener), and those of a non-oil-extension type containing no extension oil. Either type of the EPDMs is usable.

These EPDMs may be used alone or in combination.

Where any of the oil-extension type rubbers is used as the nonpolar rubber, the proportions of the following components are each defined based on 100 parts by mass of the solid nonpolar rubber contained in the oil-extension type nonpolar rubber.

<Softener>

Examples of the softener include oils; plasticizers such as dibutyl phthalate (DBP), dioctyl phthalate (DOP) and tricresyl phosphate; waxes such as polar waxes; and fatty acids such as stearic acid, which may be used alone or in combination. Of these softeners, the oils, particularly a petroleum-derived oil, are preferred.

In order to reduce the swelling percentage of the outer layer elastic material as much as possible within the range not higher than 1% as described above, an oil having a dynamic viscosity of not lower than 10 $mm^2/s$ at 100° C. is preferably used, though depending on the formulation or the like of the outer layer elastic material. Such an oil is less liable to leach out of the inner layer 2 and permeate through the outer layer 4.

Where the oil is the petroleum-derived oil, the petroleum-derived oil preferably has an aniline point of not lower than 120° C., though also depending on the formulation or the like of the outer layer elastic material. Such a petroleum-derived oil is intrinsically less liable to swell the rubber.

The upper limits of the dynamic viscosity and the aniline point are not particularly specified, but an oil having currently available upper limit dynamic viscosity and aniline point is usable. In consideration of the availability of the oil and the ease of kneading of the rubber with the oil, the oil preferably has a dynamic viscosity of not higher than 35 $mm^2/s$ at 100° C. within the aforementioned range. Further, the petroleum-derived oil preferably has an aniline point of not higher than 150° C. within the aforementioned range.

Specific examples of the petroleum-derived oil satisfying these conditions include paraffin oils such as DIANA (registered trade name) PROCESS OIL PW380 (having a dynamic viscosity of 30.86 $mm^2/s$ at 100° C. and an aniline point of 144° C.) and PW90 (having a dynamic viscosity of 10.89 $mm^2/s$ at 100° C. and an aniline point of 127.7° C.) available from Idemitsu Kosan Co., Ltd. At least one of these petroleum-derived oils is used.

The proportion of the softener (e.g., oil) is preferably not less than 15 parts by mass and not greater than 180 parts by mass, particularly preferably not less than 50 parts by mass and not greater than 150 parts by mass, based on 100 parts by mass of the overall nonpolar rubber.

If the proportion of the softener is less than the aforementioned range, it will be impossible to impart the inner layer 2 and hence the roller body 5 with proper flexibility.

If the proportion of the softener is greater than the aforementioned range, on the other hand, an excess amount of the softener is liable to permeate through the outer layer 4 and bleed on the outer peripheral surface 8 of the roller body 5 to contaminate the photoreceptor body and the like even with the outer layer 4 being made of the outer layer elastic material having a softener swelling percentage of not higher than 1%.

Where the proportion of the softener falls within the aforementioned range, in contrast, it is possible to impart the inner layer 2 and hence the roller body 5 with proper flexibility while suppressing the bleeding of the softener on the outer peripheral surface 8 of the roller body 5.

Where the oil-extension type nonpolar rubber is used, the sum of the proportion of the extension oil contained in the oil-extension type nonpolar rubber and the proportion of the softener should fall within the aforementioned range.

If the extension oil is contained in an insufficient proportion as the softener, the softener is added to the inner layer rubber composition. If the proportion of the extension oil is excessive, the non-oil-extension type nonpolar rubber is added to the inner layer rubber composition.

<Electron Conductive Agent>

The inner layer elastic material which is the crosslinked product of the inner layer rubber composition containing the basically nonconductive nonpolar rubber is preferably imparted with semiconductivity by adding an electrically conductive agent to the inner layer rubber composition.

Preferred examples of the electrically conductive agent for imparting the inner layer 2 with proper semiconductivity (electron conductivity) include electron conductive agents such as carbon and graphite having an iodine adsorption amount of not less than 80 mg/g and not greater than 150 mg/g, and an oil absorption amount of not less than 60 ml/g and not greater than 130 ml/g as measured by a mechanical method (method A).

The proportion of the electron conductive agent is preferably not less than 20 parts by mass and not greater than 80 parts by mass, particularly preferably not less than 30 parts by mass and not greater than 70 parts by mass, based on 100 parts by mass of the overall nonpolar rubber.

If the proportion of the electron conductive agent is less than the aforementioned range, it will be impossible to impart the inner layer 2 and hence the roller body 5 with proper semiconductivity. This makes it impossible to reduce the roller resistance of the semiconductive roller 1 to the roller resistance range suitable for the developing roller or the like, resulting in reduction in formed image density.

If the proportion of the electron conductive agent is greater than the aforementioned range, on the other hand, the roller body 5 is liable to have a higher hardness even with addition of a greater amount of the softener to thereby cause white voids in a formed image. Further, when the image formation is repeated, a greater stress is liable to be applied to the toner, resulting in the image density reduction and the fogging.

Where the proportion of the electron conductive agent falls within the aforementioned range, in contrast, it is possible to impart the roller body 5 with proper semiconductivity and control the roller resistance of the semiconductive roller 1 within the roller resistance range suitable for the developing roller or the like, while imparting the inner layer 2 and hence the roller body 5 with proper flexibility.

<Crosslinking Component>

A crosslinking agent for crosslinking the nonpolar rubber and a crosslinking accelerating agent for accelerating the crosslinking of the nonpolar rubber with the crosslinking agent are preferably used in combination as the crosslinking component.

Preferred examples of the crosslinking agent include a sulfur crosslinking agent, a thiourea cross linking agent, a triazine derivative crosslinking agent, a peroxide crosslinking agent and monomers. Particularly, the sulfur crosslinking agent is preferred.

(Sulfur Crosslinking Agent)

Examples of the sulfur crosslinking agent include sulfur such as sulfur powder, oil-treated sulfur powder, precipitated sulfur, colloidal sulfur and dispersive sulfur, and organic sulfur-containing compounds such as tetramethylthiuram disulfide and N,N-dithiobismorpholine. Particularly, the sulfur is preferred.

The proportion of the sulfur to be blended is preferably not less than 0.5 parts by mass and not greater than 2 parts by mass based on 100 parts by mass of the overall nonpolar rubber.

The sulfur functions to properly crosslink the nonpolar rubber to impart the inner layer 2 with proper rubber characteristic properties, i.e., to make the inner layer 2 flexible and less susceptible to permanent compressive deformation with a reduced compression set. If the proportion of the sulfur is less than the aforementioned range, it will be impossible to sufficiently provide such effects.

If the proportion of the sulfur is greater than the aforementioned range, on the other hand, an excess amount of the sulfur is liable to bloom on the outer peripheral surface 3 of the inner layer 2 (in an interface between the inner layer 2 and the outer layer 4) to hinder the adhesion of the outer layer 4.

Where the oil-treated sulfur powder, the dispersive sulfur or the like is used as the sulfur, for example, the proportion of the sulfur described above is defined as the effective proportion of sulfur contained in the oil-treated sulfur powder or the dispersive sulfur.

Where the organic sulfur-containing compound is used as the sulfur crosslinking agent, the proportion of the organic sulfur-containing crosslinking agent is preferably adjusted so that the proportion of sulfur contained in molecules of the organic sulfur-containing crosslinking agent falls within the aforementioned range based on 100 parts by mass of the overall nonpolar rubber.

(Crosslinking Accelerating Agent)

Examples of a crosslinking accelerating agent for accelerating the crosslinking of the nonpolar rubber with the sulfur crosslinking agent include a thiazole accelerating agent, a thiuram accelerating agent, a sulfenamide accelerating agent and a dithiocarbamate accelerating agent, which may be used alone or in combination. Of these crosslinking accelerating agents, the thiuram accelerating agent and the thiazole accelerating agent are preferably used in combination.

Examples of the thiuram accelerating agent include tetramethylthiuram monosulfide, tetramethylthiuram disulfide, tetraethylthiuram disulfide, tetrabutylthiuram disulfide and dipentamethylenethiuram tetrasulfide, which may be used alone or in combination.

Examples of the thiazole accelerating agent include 2-mercaptobenzothiazole, di-2-benzothiazolyl disulfide, a zinc salt of 2-mercaptobenzothiazole, a cyclohexylamine salt of 2-mercaptobenzothiazole and 2-(4'-morpholinodithio)benzothiazole, which may be used alone or in combination.

Where the two types of crosslinking accelerating agents are used in combination, the proportion of the thiuram accelerating agent to be blended is preferably not less than 0.3 parts by mass and not greater than 2 parts by mass based on 100 parts by mass of the overall nonpolar rubber, and the proportion of the thiazole accelerating agent to be blended is preferably not less than 0.3 parts by mass and not greater than 2 parts by mass based on 100 parts by mass of the overall nonpolar rubber in order to sufficiently provide the effect of these crosslinking accelerating agents for accelerating the crosslinking of the nonpolar rubber with the sulfur crosslinking agent.

<Other Ingredients>

As required, various additives may be added to the inner layer rubber composition. One example of the additives is an acceleration assisting agent.

Examples of the acceleration assisting agent include metal compounds such as zinc white (zinc oxide), fatty acids such as stearic acid, oleic acid and cottonseed fatty acids, and other conventionally known acceleration assisting agents, which may be used alone or in combination.

The proportion of the acceleration assisting agent to be added is preferably not less than 0.1 part by mass and not greater than 7 parts by mass, particularly preferably not less than 0.5 parts by mass and not greater than 5 parts by mass, based on 100 parts by mass of the overall nonpolar rubber.

Other examples of the additives include a degradation preventing agent, a filler, an anti-scorching agent, a lubricant, a pigment, an antistatic agent, a flame retarder, a neutralizing agent, a nucleating agent and a co-crosslinking agent, which may be blended in proper proportions.

<Preparation of Inner Layer Rubber Composition>

The inner layer rubber composition containing the aforementioned ingredients can be prepared in a conventional manner. First, the nonpolar rubber is simply kneaded. Then, the softener and the additives other than the crosslinking component are added to and kneaded with the nonpolar rubber, and the crosslinking component is finally added to and further kneaded with the resulting mixture. Thus, the inner layer rubber composition is prepared. A kneader, a Banbury mixer or an extruder, for example, may be used for the kneading.

<<Outer Layer Rubber Composition>>

<Rubber>

A rubber for the outer layer rubber composition is preferably less compatible with the softener, i.e., is different in SP value from the softener by a difference of not less than 1, so that the swelling percentage of the outer layer elastic material can be controlled to not higher than 1% as described above when the outer layer elastic material is immersed in the softener to be contained in the inner layer 2 at 100° C. for 24 hours.

Where the petroleum-derived oil or the like is used as the softener, for example, the rubber satisfying the aforementioned conditions is a polar rubber such as epichlorohydrin rubber and acrylonitrile butadiene rubber (NBR), at least one of which is used.

Since the aforementioned polar rubber has ion conductivity, the outer layer elastic material which is the crosslinked product of the outer layer rubber composition is imparted with proper semiconductivity (ion conductivity).

Where the outer layer 4 made of the outer layer elastic material is combined with the inner layer 2 described above, therefore, it is possible to impart the roller body 5 with proper semiconductivity to control the roller resistance of the semiconductive roller 1 within the roller resistance range suitable for the developing roller.

(Epichlorohydrin Rubber)

Various polymers containing epichlorohydrin as a repeating unit are usable as the epichlorohydrin rubber.

Examples of the epichlorohydrin rubber include epichlorohydrin homopolymers, epichlorohydrin-ethylene oxide bipolymers (ECO), epichlorohydrin-propylene oxide bipolymers, epichlorohydrin-allyl glycidyl ether bipolymers, epichlorohydrin-ethylene oxide-allyl glycidyl ether terpolymers (GECO), epichlorohydrin-propylene oxide-allyl glycidyl ether terpolymers and epichlorohydrin-ethylene oxide-propylene oxide-allyl glycidyl ether quaterpolymers, which may be used alone or in combination.

Of these epichlorohydrin rubbers, the ethylene oxide-containing copolymers, particularly the ECO and/or the GECO, are preferred for reducing the roller resistance of the semiconductive roller 1 to the roller resistance range suitable for the developing roller or the like.

These copolymers preferably each have an ethylene oxide content of not less than 30 mol % and not greater than 80 mol %, particularly preferably not less than 50 mol %.

Ethylene oxide functions to reduce the roller resistance of the semiconductive roller 1. If the ethylene oxide content is less than the aforementioned range, however, it will be impossible to sufficiently provide this function and hence to sufficiently reduce the roller resistance.

If the ethylene oxide content is greater than the aforementioned range, on the other hand, ethylene oxide is liable to be crystallized, whereby the segment motion of molecular chains is hindered to adversely increase the roller resistance of the semiconductive roller 1. Further, the outer layer 4 is liable to have an excessively high hardness after the crosslinking, and the outer layer rubber composition is liable to have a higher viscosity and, hence, poorer processability when being heat-melted before the crosslinking.

The ECO has an epichlorohydrin content that is a balance obtained by subtracting the ethylene oxide content from the total. That is, the epichlorohydrin content is preferably not less than 20 mol % and not greater than 70 mol %, particularly preferably not greater than 50 mol %.

The GECO preferably has an allyl glycidyl ether content of not less than 0.5 mol % and not greater than 10 mol %, particularly preferably not less than 2 mol % and not greater than 5 mol %.

Allyl glycidyl ether per se functions as side chains of the copolymer to provide a free volume, whereby the crystallization of ethylene oxide is suppressed to reduce the roller resistance of the semiconductive roller 1. However, if the allyl glycidyl ether content is less than the aforementioned range, it will be impossible to provide this function and, hence, to sufficiently reduce the roller resistance.

Allyl glycidyl ether also functions as crosslinking sites during the crosslinking of the GECO. Therefore, if the allyl glycidyl ether content is greater than the aforementioned range, the crosslinking density of the GECO is excessively increased, whereby the segment motion of molecular chains is hindered to adversely increase the roller resistance.

The GECO has an epichlorohydrin content that is a balance obtained by subtracting the ethylene oxide content and the allyl glycidyl ether content from the total. That is, the epichlorohydrin content is preferably not less than 10 mol % and not greater than 69.5 mol %, particularly preferably not less than 19.5 mol % and not greater than 60 mol %.

Examples of the GECO include copolymers of the three comonomers described above in a narrow sense, as well as known modification products obtained by modifying an epichlorohydrin-ethylene oxide copolymer (ECO) with allyl glycidyl ether. In the present invention, any of these modification products may be used as the GECO.

These epichlorohydrin rubbers may be used alone or in combination.

(NBR)

A lower acrylonitrile content type NBR having an acrylonitrile content of not greater than 24%, an intermediate acrylonitrile content type NBR having an acrylonitrile content of 25 to 30%, an intermediate to higher acrylonitrile content type NBR having an acrylonitrile content of 31 to 35%, a higher acrylonitrile content type NBR having an acrylonitrile content of 36 to 42% and a very high acrylonitrile content type NBR having an acrylonitrile content of not less than 43% are usable as the NBR.

Where the petroleum-derived oil is used as the oil, for example, NBR which is less compatible with the petroleum-derived oil with a greater SP value difference and is highly polar, i.e., intermediate to very high acrylonitrile content NBR having an acrylonitrile content of not less than 25%, is preferably used in order to reduce the swelling percentage of the outer layer elastic material as much as possible within the range not higher than 1%.

The NBRs include those of an oil-extension type having flexibility controlled by addition of an extension oil (softener), and those of a non-oil-extension type containing no extension oil. In the present invention, a non-oil-extension type NBR which does not contain the extension oil (which may be a bleed substance) is preferably used for the prevention of the contamination of the photoreceptor body and the like.

These NBRs may be used alone or in combination.

<Crosslinking Component>

A crosslinking agent for crosslinking the polar rubber and a crosslinking accelerating agent for accelerating the crosslinking of the polar rubber with the crosslinking agent are preferably used in combination as the crosslinking component.

Examples of the crosslinking agent include those described for the inner layer 2, i.e., a sulfur crosslinking agent, a thiourea crosslinking agent, a triazine derivative crosslinking agent, a peroxide crosslinking agent, and monomers.

(Thiourea Crosslinking Agent and Crosslinking Accelerating Agent)

Where the epichlorohydrin rubber is used alone as the polar rubber, the thiourea crosslinking agent is preferably used out of the crosslinking agents described above.

Various thiourea compounds each having a thiourea structure in a molecule thereof and functioning as a crosslinking agent for the epichlorohydrin rubber are usable as the thiourea crosslinking agent.

Examples of the thiourea crosslinking agent include ethylene thiourea, N,N'-diphenylthiourea, trimethylthiourea, thioureas represented by the following formula (1):

$$(C_nH_{2n+1}NH)_2C{=}S \quad (1)$$

(wherein n is an integer of 1 to 12), and tetramethylthiourea, which may be used alone or in combination. Particularly, ethylene thiourea is preferred.

The proportion of the thiourea crosslinking agent to be blended is preferably not less than 0.2 parts by mass and not greater than 3 parts by mass, particularly preferably not less than 1 part by mass, based on 100 parts by mass of the overall polar rubber.

If the proportion of the thiourea crosslinking agent is less than the aforementioned range, the crosslinking of the epichlorohydrin rubber will be insufficient, so that the outer layer elastic material is liable to have a swelling percentage of higher than 1%. Further, the outer layer 4 is liable to have a poorer durability to be thereby worn out or broken in a relatively short period of time.

If the proportion of the thiourea crosslinking agent is greater than the aforementioned range, on the other hand, the outer layer 4 is liable to be excessively hard, or an excess amount of the thiourea crosslinking agent is liable to bloom on the surface of the outer layer 4 or the outer peripheral surface 8 of the roller body 5 to contaminate the photoreceptor body and the like.

Examples of a crosslinking accelerating agent to be used in combination with the thiourea crosslinking agent include guanidine accelerating agents such as 1,3-diphenylguanidine, 1,3-di-o-tolylguanidine and 1-o-tolylbiguanide, which may be used alone or in combination.

The proportion of the crosslinking accelerating agent to be blended is preferably not less than 0.2 parts by mass and not greater than 2 parts by mass, particularly preferably not less than 1 part by mass, based on 100 parts by mass of the overall polar rubber in order to sufficiently provide the effect of the crosslinking accelerating agent for accelerating the crosslinking of the epichlorohydrin rubber.

(Sulfur Crosslinking Agent and Crosslinking Accelerating Agent)

Where the epichlorohydrin rubber and the NBR or the like are used in combination as the polar rubber, or where the epichlorohydrin rubber is not used as the polar rubber, the sulfur crosslinking agent is preferably used as the crosslinking agent.

Examples of the sulfur crosslinking agent include those to be used for the inner layer 2, i.e., sulfur such as sulfur powder, oil-treated sulfur powder, precipitated sulfur, colloidal sulfur and dispersive sulfur, and organic sulfur-containing compounds such as tetramethylthiuram disulfide and N,N-dithiobismorpholine. The proportion of the sulfur crosslinking agent is preferably substantially the same as that for the inner layer 2 for the same reasons.

A crosslinking accelerating agent capable of accelerating the crosslinking of the polar rubber with the sulfur crosslinking agent is usable as the crosslinking accelerating agent. Examples of the crosslinking accelerating agent include a thiazole accelerating agent, a thiuram accelerating agent, a sulfenamide accelerating agent and a dithiocarbamate accelerating agent, which may be used alone or in combination. Particularly, the thiuram accelerating agent and the thiazole accelerating agent are preferably used in combination.

Usable examples of the thiuram accelerating agent and the thiazole accelerating agent include those to be used for the inner layer 2. The proportions of the thiuram accelerating agent and the thiazole accelerating agent are preferably substantially the same as those for the inner layer 2 for the same reasons.

The thiourea crosslinking agent and the guanidine accelerating agent described above may be used in combination with the sulfur crosslinking agent and its crosslinking accelerating agent described above as the crosslinking agent and the crosslinking accelerating agent.

The proportion of the thiourea crosslinking agent to be used in the combination system is preferably not less than 0.2 parts by mass and not greater than 1 part by mass, particularly preferably not greater than 0.5 parts by mass, based on 100 parts by mass of the overall polar rubber.

The proportion of the guanidine accelerating agent to be blended is preferably not less than 0.2 parts by mass and not greater than 1 part by mass, particularly preferably not greater than 0.5 parts by mass, based on 100 parts by mass of the overall polar rubber.

<Other Ingredients>

As required, various additives may be added to the outer layer rubber composition. Examples of the additives include an acceleration assisting agent, an acid accepting agent and a filler.

Examples of the acceleration assisting agent include those to be used for the inner layer 2, i.e., metal compounds such as zinc white, and fatty acids such as stearic acid. The proportion of the acceleration assisting agent is preferably substantially the same as that for the inner layer 2 for the same reasons.

In the presence of the acid accepting agent, chlorine-containing gases generated from the epichlorohydrin rubber and the like during the crosslinking are prevented from remaining in the outer layer 4. Thus, the acid accepting agent functions to prevent the inhibition of the crosslinking and the contamination of the photoreceptor body and the like, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where the hydrotalcites are used in combination with magnesium oxide or potassium oxide, a higher acid accepting effect can be provided, thereby more reliably preventing the contamination of the photoreceptor body and the like.

The proportion of the acid accepting agent to be added is preferably not less than 0.1 part by mass and not greater than 7 parts by mass based on 100 parts by mass of the overall polar rubber.

Examples of the filler include zinc oxide, silica, carbon black, clay, talc, calcium carbonate, magnesium carbonate and aluminum hydroxide, which may be used alone or in combination. The addition of the filler improves the mechanical strength and the like of the outer layer 4.

The outer layer 4 may be imparted with electron conductivity by using electrically conductive carbon black as the filler.

The proportion of the filler to be added is preferably not less than 5 parts by mass and not greater than 30 parts by mass, particularly preferably not less than 10 parts by mass and not greater than 25 parts by mass, based on 100 parts by mass of the overall polar rubber.

Other examples of the additives include a degradation preventing agent, an anti-scorching agent, a lubricant, a pigment, an antistatic agent, a flame retarder, a neutralizing agent, a nucleating agent and a co-crosslinking agent, which may be blended in proper proportions.

<Preparation of Outer Layer Rubber Composition>

The outer layer rubber composition containing the aforementioned ingredients can be prepared in a conventional manner. First, the polar rubber is simply kneaded. Then, the additives other than the crosslinking component are added to and kneaded with the polar rubber, and the crosslinking component is finally added to and further kneaded with the resulting mixture. Thus, the outer layer rubber composition is prepared. A kneader, a Banbury mixer or an extruder, for example, may be used for the kneading.

<<Production of Semiconductive Roller 1>>

Where the semiconductive roller 1 shown in FIGS. 1A and 1B is to be produced by forming the roller body 5 through a coextrusion method by means of a double-layer extruder as described above, the inner layer rubber composition and the outer layer rubber composition are fed into the double-layer extruder.

Then, the inner layer rubber composition and the outer layer rubber composition are simultaneously extruded into a tubular body, so that a tubular layer of the outer layer rubber composition is formed on an outer periphery of a tubular layer of the inner layer rubber composition. In turn, the tubular body is cut to a predetermined length, and crosslinked in a vulcanization can by pressure and heat.

Subsequently, the crosslinked tubular body is secondarily crosslinked with heating in an oven or the like, and then cooled. Thereafter, the resulting tubular body is polished to a predetermined outer diameter. Thus, a roller body 5 including a laminate of an inner layer 2 and an outer layer 4 is formed.

The thickness of the inner layer 2 may be properly set according to the construction, the dimensions and the like of an image forming apparatus in which the semiconductive roller 1 is to be incorporated.

The thickness of the outer layer 4 may also be properly set, but is preferably not less than 0.1 mm and not greater than 2.5 mm, particularly preferably not less than 0.3 mm and not greater than 1 mm.

If the thickness of the outer layer 4 is less than the aforementioned range, it will be impossible to sufficiently prevent the softener from permeating through the outer layer 4 even with the outer layer 4 being made of the outer layer elastic material having a softener swelling percentage of not higher than 1%. Therefore, the softener is liable to bleed on the outer peripheral surface 8 of the roller body 5 to contaminate the photoreceptor body and the like.

If the thickness of the outer layer 4 is greater than the aforementioned range, on the other hand, the semiconductive roller 1 is liable to have a higher roller resistance, thereby suffering from the reduction in formed image density.

Various polishing methods such as a dry traverse polishing method can be employed for the polishing.

The outer peripheral surface 8 may be mirror-finished at the final stage of the polishing step. In this case, the mirror-finishing improves the releasability of the outer peripheral surface 8 and, with or without the formation of the oxide film 9, further advantageously suppresses the adhesion of the toner to the outer peripheral surface 8. This effectively prevents the contamination of the photoreceptor body and the like.

The shaft 7 may be inserted through and fixed to the through-hole 6 at any time between the end of the cutting of the tubular body for the roller body 5 and the end of the polishing.

However, it is preferred to carry out the secondary crosslinking and the polishing with the shaft 7 inserted through the through-hole 6 after the cutting. This suppresses the warpage and the deformation of the roller body 5, which may otherwise occur due to the expansion and the contraction of the tubular body during the secondary crosslinking. Further, the tubular body may be polished while being rotated about the shaft 7. This improves the working efficiency in the polishing, and suppresses the deflection of the outer peripheral surface 8.

As previously described, the shaft 7 having an outer diameter greater than the inner diameter of the through-hole 6 may be press-inserted into the through-hole 6, or the shaft 7 may be inserted through the through-hole 6 of the tubular body with the intervention of an electrically conductive thermosetting adhesive agent between the shaft 7 and the tubular body before the secondary crosslinking.

In the former case, the electrical connection and the mechanical fixing are achieved simultaneously with the press insertion of the shaft 7.

In the latter case, the thermosetting adhesive agent is cured when the tubular body is heated in the oven for the secondary crosslinking, whereby the shaft 7 is electrically connected to and mechanically fixed to the roller body 5.

As described above, the formation of the oxide film 9 is preferably achieved by the irradiation of the outer peripheral surface 8 of the roller body 5 (the surface of the outer layer 4) with the ultraviolet radiation. That is, this method is simple and efficient, because the formation of the oxide film 9 is achieved simply through the oxidation of the polar rubber present in the outer peripheral surface 8 of the roller body 5 by irradiating the outer peripheral surface 8 with ultraviolet radiation having a predetermined wavelength for a predetermined period.

In addition, the oxide film 9 formed by the irradiation with the ultraviolet radiation is free from conventional problems associated with a coating film formed by applying a coating agent, and is highly uniform in thickness, and ensures tight adhesion thereof to the roller body 5.

The wavelength of the ultraviolet radiation to be used for the irradiation is preferably not less than 100 nm and not greater than 400 nm, particularly preferably not greater than 300 nm, in order to efficiently oxidize the polar rubber of the outer layer rubber composition for the formation of the oxide film 9 excellent in the aforementioned functions. The irradiation period is preferably not shorter than 30 seconds and not longer than 30 minutes, particularly preferably not shorter than 1 minute and not longer than 20 minutes.

The oxide film 9 may be formed by other methods and, in some case, may be obviated.

One or two or more intermediate layers may be provided between the inner layer 2 and the outer layer 4. For simplification of the structure of the roller body 5, the roller body 5 preferably has a double layer structure including the inner layer 2 and the outer layer 4 directly stacked on the inner layer 2 as shown in FIGS. 1A and 1B.

The inventive semiconductive roller 1 can be advantageously used not only as a developing roller but also as a charging roller, a transfer roller, a cleaning roller or the like to be incorporated in an electrophotographic image forming apparatus such as a laser printer, an electrostatic copying machine, a plain paper facsimile machine, and a printer-copier-facsimile multifunction machine.

EXAMPLES

The present invention will hereinafter be described in greater detail by way of Examples and Comparative Examples but not by way of limitation.

<Inner Layer Rubber Composition (a)>

IR (non-oil-extension type IR, Nipol (registered trade name) IR2200 available from Nippon Zeon Corporation, and having a Mooney viscosity of 82 (median)) was used as a nonpolar rubber.

While 100 parts by mass of the nonpolar rubber was simply kneaded by means of a Banbury mixer, the following ingredients were added to and further kneaded with the nonpolar rubber.

TABLE 1

| Ingredients | Parts by mass |
|---|---|
| Zinc oxide type-2 | 5 |
| Carbon | 40 |
| Petroleum-derived oil | 60 |

The ingredients shown in Table 1 are as follows. The amounts (parts by mass) of the ingredients shown in Table 1 are based on 100 parts by mass of the overall nonpolar rubber.

Zinc oxide type-2: Crosslinking accelerating agent (available from Sakai Chemical Industry Co., Ltd.)

Carbon: Electron conductive agent (SHOBLACK (registered trade name) N220 available from Cabot Japan K. K., and having an iodine adsorption amount of 119 mg/g and an oil absorption amount of 115 ml/g)

Petroleum-derived oil: Softener (paraffin oil, DIANA PROCESS OIL PW380 available from Idemitsu Kosan Co., Ltd., and having a dynamic viscosity of 30.86 $mm^2/s$ at 100° C. and an aniline point of 144° C.)

While the resulting mixture was continuously kneaded, the following crosslinking component was further added to and kneaded with the mixture. Thus, an inner layer rubber composition (a) was prepared.

TABLE 2

| Ingredients | Parts by mass |
|---|---|
| Thiazole accelerating agent | 1.5 |
| Thiuram accelerating agent | 0.5 |
| Sulfur | 1.05 |

The ingredients shown in Table 2 are as follows. The amounts (parts by mass) of the ingredients shown in Table 2 are based on 100 parts by mass of the overall nonpolar rubber.

Thiazole accelerating agent: Di-2-benzothiazyl disulfide (NOCCELER (registered trade name) DM-P available from Ouchi Shinko Chemical Industrial Co., Ltd.)

Thiuram accelerating agent: Tetramethylthiuram monosulfide (SANCELER (registered trade name) TS available from Sanshin Chemical Industry Co., Ltd.)

Sulfur: Crosslinking agent (5% oil-containing fine sulfur powder, KINKA MARK available from Tsurumi Chemical Industry Co., Ltd.)

<Inner Layer Rubber Composition (b)>

An inner layer rubber composition (b) was prepared in substantially the same manner as the inner layer rubber composition (a), except that 100 parts by mass of EPDM (non-oil-extension type EPDM, MITSUI EPT 9090M available from Mitsui Chemicals, Inc., and having a Mooney viscosity (ML(1+4) at 125° C.) of 58, an ethylene content of 41 wt % and a diene content (ENB) of 14.0 wt %) was used as the nonpolar rubber, and the proportion of the carbon and the proportion of the paraffin oil were 65 parts by mass and 145 parts by mass, respectively, based on 100 parts by mass of the EPDM.

<Inner Layer Rubber Composition (c)>

An inner layer rubber composition (c) was prepared in substantially the same manner as the inner layer rubber composition (a), except that 100 parts by mass of BR (non-oil-extension type BR, UBEPOL (registered trade name) BR360L available from Ube Industries, Ltd., and having a Mooney viscosity (ML(1+4) at 100° C.) of 83) was used as the nonpolar rubber.

<Inner Layer Rubber Composition (d)>

An inner layer rubber composition (d) was prepared in substantially the same manner as the inner layer rubber composition (a), except that 60 parts by mass of a paraffin oil (DIANA PROCESS OIL PW90 available from Idemitsu Kosan Co., Ltd., and having a dynamic viscosity of 10.89 $mm^2/s$ at 100° C. and an aniline point of 127.7° C.) was used as the petroleum-derived oil.

<Inner Layer Rubber Composition (e)>

An inner layer rubber composition (e) was prepared in substantially the same manner as the inner layer rubber composition (a), except that 100 parts by mass of BR (non-oil-extension type BR, UBEPOL BR360L available from Ube Industries, Ltd., and having a Mooney viscosity (ML(1+4) at 100° C.) of 83) was used as the nonpolar rubber, and 60 parts by mass of a paraffin oil (DIANA PROCESS OIL PW90 available from Idemitsu Kosan Co., Ltd., and having a dynamic viscosity of 10.89 $mm^2/s$ at 100° C. and an aniline point of 127.7° C.) was used as the petroleum-derived oil.

<Inner Layer Rubber Composition (f)>

An inner layer rubber composition (f) was prepared in substantially the same manner as the inner layer rubber composition (a), except that 60 parts by mass of an aroma-type process oil (T-DAE, VivaTec 400 available from H &

R Company, and having a dynamic viscosity of 18.8 $mm^2/s$ at 100° C. and an aniline point of 72.3° C.) was used as the petroleum-derived oil.

<Inner Layer Rubber Composition (g)>

An inner layer rubber composition (g) was prepared in substantially the same manner as the inner layer rubber composition (a), except that 60 parts by mass of a paraffin oil (DIANA PROCESS OIL PW32 available from Idemitsu Kosan Co., Ltd., and having a dynamic viscosity of 5.285 $mm^2/s$ at 100° C. and an aniline point of 115° C.) was used as the petroleum-derived oil.

<Outer Layer Rubber Composition (A)>

A polar rubber was prepared by blending 40 parts by mass of GECO (HYDRIN (registered trade name) T3108 available from Nippon Zeon Corporation, and having a Mooney viscosity of 47 (median)) and 60 parts by mass of NBR (intermediate to higher acrylonitrile content NBR of non-oil-extension type, Nipol DN219 available from Nippon Zeon Corporation, and having an acrylonitrile content of 33.5% and a Mooney viscosity of 27 (median)).

While 100 parts by mass of the resulting polar rubber was simply kneaded by means of a Banbury mixer, the following ingredients were added to and kneaded with the polar rubber.

TABLE 3

| Ingredients | Parts by mass |
|---|---|
| Zinc oxide type-2 | 5 |
| Hydrotalcites | 3 |
| Carbon black | 20 |

The ingredients shown in Table 3 are as follows. The amounts (parts by mass) of the ingredients shown in Table 3 are based on 100 parts by mass of the overall polar rubber.

Zinc oxide type-2: Crosslinking accelerating agent (available from Sakai Chemical Industry Co., Ltd.)

Hydrotalcites: Acid accepting agent (DHT-4A (registered trade name) 2 available from Kyowa Chemical Industry Co., Ltd.)

Carbon black: FEF, SEAST SO available from Tokai Carbon Co., Ltd.

While the resulting mixture was continuously kneaded, the following crosslinking component was further added to and kneaded with the mixture. Thus, an outer layer rubber composition (A) was prepared.

TABLE 4

| Ingredients | Parts by mass |
|---|---|
| Thiazole accelerating agent | 1.5 |
| Thiuram accelerating agent | 0.5 |
| Thiourea crosslinking agent | 0.33 |
| Guanidine accelerating agent | 0.28 |
| Sulfur | 1.05 |

The ingredients shown in Table 4 are as follows. The amounts (parts by mass) of the ingredients shown in Table 4 are based on 100 parts by mass of the overall polar rubber.

Thiazole accelerating agent: Di-2-benzothiazyl disulfide (NOCCELER DM-P available from Ouchi Shinko Chemical Industrial Co., Ltd.)

Thiuram accelerating agent: Tetramethylthiurammonosulfide (SANCELER TS available from Sanshin Chemical Industry Co., Ltd.)

Thiourea crosslinking agent: Ethylene thiourea (2-mercaptoimidazoline ACCEL (registered trade name) 22-S available from Kawaguchi Chemical Industry Co., Ltd.)

Guanidine accelerating agent: 1,3-di-o-tolylguanidine (SANCELER DT available from Sanshin Chemical Industry Co., Ltd.)

Sulfur: Crosslinking agent (5% oil-containing fine sulfur powder, KINKA MARK available from Tsurumi Chemical Industry Co., Ltd.)

<Outer Layer Rubber Composition (B)>

An outer layer rubber composition (B) was prepared in substantially the same manner as the outer layer rubber composition (A), except that 100 parts by mass of GECO (HYDRIN T3108 available from Nippon Zeon Corporation, and having a Mooney viscosity of 47 (median)) was used as the polar rubber, and 2 parts by mass of the thiourea crosslinking agent and 1.7 parts by mass of the guanidine accelerating agent based on 100 parts by mass of the GECO were used as the crosslinking component.

<Outer Layer Rubber Composition (C)>

An outer layer rubber composition (C) was prepared in substantially the same manner as the outer layer rubber composition (A), except that 100 parts by mass of NBR (intermediate to higher acrylonitrile content NBR of non-oil-extension type, Nipol DN219 available from Nippon Zeon Corporation, and having an acrylonitrile content of 33.5% and a Mooney viscosity of 27 (median)) was used as the polar rubber.

<Outer Layer Rubber Composition (D)>

An outer layer rubber composition (D) was prepared in substantially the same manner as the outer layer rubber composition (A), except that the polar rubber was prepared by blending 20 parts by mass of GECO (HYDRIN T3108 available from Nippon Zeon Corporation, and having a Mooney viscosity of 47 (median)) and 80 parts by mass of NBR (lower acrylonitrile content NBR of non-oil-extension type, Nipol DN401LL available from Nippon Zeon Corporation, and having an acrylonitrile content of 18.0% and a Mooney viscosity of 32 (median)).

<Outer Layer Rubber Composition (E)>

An outer layer rubber composition (E) was prepared in substantially the same manner as the outer layer rubber composition (A), except that 100 parts by mass of chloroprene rubber (non-oil-extension type CR, SHOPRENE (registered trade name) WRT available from Showa Denko K. K.) was used as the polar rubber.

Examples 1 to 7 and Comparative Examples 1 to 4>

The inner layer rubber compositions (a) to (g) and the outer layer rubber compositions (A) to (E) prepared in the aforementioned manner were used in combination as shown in Tables 5 and 6. The inner layer rubber composition and the outer layer rubber composition were fed into a double-layer extruder, and extruded into a double-layered tubular body having an outer diameter of 16 mm and an inner diameter of 6.5 mm and including an inner layer tubular body having a thickness of 3.75 mm. The double-layered tubular body was fitted around a temporary crosslinking shaft, and crosslinked in a vulcanization can at 160° C. for 1 hour.

Then, the crosslinked tubular body was removed from the temporary shaft, then fitted around a shaft having an outer diameter of 7.5 mm and an outer peripheral surface to which an electrically conductive thermosetting adhesive agent was applied, and heated in an oven at 160° C.

Subsequently, opposite end portions of the tubular body were cut, and the outer peripheral surface of the resulting tubular body was traverse-polished by a cylindrical polishing machine, and then mirror-polished to an outer diameter of 16.00 mm (with a tolerance of 0.05). Thus, a roller body was produced, which had a double layer structure including an inner layer and an outer layer and was unified with the shaft. The outer layer had a thickness of about 0.5 mm.

After the outer peripheral surface of the roller body thus produced was wiped with alcohol, the roller body was set in a UV irradiation apparatus (PL21-200 available from Sen Lights Corporation) with the outer peripheral surface spaced 50 mm from a UV lamp. The roller body was irradiated with ultraviolet radiation at wavelengths of 184.9 nm and 253.7 nm for 15 minutes each time the roller body was rotated about the shaft by 90 degrees. Thus, an oxide film was formed in the outer peripheral surface of the roller body. In this manner, a semiconductive roller was produced.

<Measurement of Swelling Percentage>

The outer layer rubber compositions (A) to (E) were each formed into a sheet, which was in turn crosslinked. Then, a square test piece having a size of 2 cm×2 cm was cut out of the crosslinked sheet.

Then, the immersion test specified in Japanese Industrial Standards K6258:2003 "Rubber, vulcanized or thermoplastic—Determination of the effect of liquids" was performed on the test piece by immersing the test piece in the same petroleum-derived oil as contained in the corresponding inner layer rubber composition at an immersion temperature of 100° C. for an immersion period of 24 hours with the surface of the test piece not exposed in air.

The mass of the test piece was measured in air and in water before and after the immersion, and the swelling percentage (=volume change percentage) $\Delta V_{100}$ (%) was calculated from the expression (1) previously described.

<Bleeding Evaluation I>

The semiconductive rollers produced in Examples and Comparative Examples were each maintained at a temperature of 45° C. for 5 days. Thereafter, a probe of a probe-type Fourier transform infrared spectrophotometer was brought into contact with the outer peripheral surface of the roller body of each of the semiconductive rollers, and then an infrared spectrum was obtained with the probe brought out of contact with the outer peripheral surface.

Further, samples were prepared by forming the outer layer rubber compositions (A) to (E) into sheets, and an infrared spectrum was obtained for each of the samples in the same manner. Where there was a difference between the infrared spectra thus obtained, the semiconductive roller was regarded as suffering from the bleeding (x). Where there was no difference between the infrared spectra, the semiconductive roller was regarded as being free from the bleeding (o).

<Bleeding Evaluation II>

A new cartridge (including a toner container containing toner, a photoreceptor body, and a developing roller kept in contact with the photoreceptor body) for a commercially available laser printer was prepared, and the semiconductive rollers produced in Examples and Comparative Examples were each incorporated as a developing roller in the cartridge instead of the original developing roller.

The laser printer was operative with the use of a positively-chargeable nonmagnetic single-component toner, and capable of forming images on up to 4000 A4-size sheets (declared value) as determined by a measurement method specified in Japanese Industrial Standards JIS $X6932_{:2003}$ "Method for the determination of toner cartridge yield for color printers and multifunction devices that contain printer components."

The cartridge was maintained at a temperature of 45° C. for 5 days, and then set in the laser printer. Afterimages were sequentially formed on 20 plain paper sheets at a density of 1% at a temperature of 23.5° C. at a relative humidity of 55%, solid images were formed on two plain paper sheets. The semiconductive roller was evaluated for bleeding based on the following criteria.

o: Any image defect such as streaking was not observed in the black solid images. The semiconductive roller was regarded as being free from the bleeding.

x: Image defect was observed. The semiconductive roller was regarded as suffering free from the bleeding.

The results are shown in Tables 5 and 6.

TABLE 5

| | Example 1 | Example 2 | Example 3 | Comparative Example 1 | Comparative Example 2 |
|---|---|---|---|---|---|
| Inner layer | | | | | |
| Inner layer rubber composition | a | a | a | a | a |
| Rubber (parts by mass) | | | | | |
| BR | — | — | — | — | — |
| IR | 100 | 100 | 100 | 100 | 100 |
| EPDM | — | — | — | — | — |
| Petroleum-derived oil | | | | | |
| Dynamic viscosity ($mm^2/s$) | 30.86 | 30.86 | 30.86 | 30.86 | 30.86 |
| Aniline point (° C.) | 144 | 144 | 144 | 144 | 144 |
| Parts by mass | 60 | 60 | 60 | 60 | 60 |
| Outer layer | | | | | |
| Outer layer rubber composition | A | B | C | D | E |
| Rubber (parts by mass) | | | | | |
| GECO | 40 | 100 | — | 20 | — |
| NBR*1 | 60 | — | 100 | — | — |
| NBR*2 | — | — | — | 80 | — |
| CR | — | — | — | — | 100 |
| Evaluation | | | | | |
| Swelling percentage of outer layer (%) | 0.35 | 0.31 | 0.22 | 1.21 | 2.97 |
| Bleeding evaluation I | ○ | ○ | ○ | x | x |
| Bleeding evaluation II | ○ | ○ | ○ | x | x |

*1Acrylonitrile content was 33.5%.

*2Acrylonitrile content was 18.0%.

TABLE 6

| | Example 4 | Example 5 | Example 6 | Example 7 | Comparative Example 3 | Comparative Example 4 |
|---|---|---|---|---|---|---|
| Inner layer | | | | | | |
| Inner layer rubber composition | b | c | d | e | f | g |
| Rubber (parts by mass) | | | | | | |
| BR | — | 100 | — | 100 | — | |
| IR | — | — | 100 | — | 100 | 100 |
| EPDM | 100 | — | — | — | — | — |
| Petroleum-derived oil | | | | | | |
| Dynamic viscosity ($mm^2/s$) | 30.86 | 30.86 | 10.89 | 10.89 | 18.8 | 5.285 |
| Aniline point (° C.) | 144 | 144 | 127.7 | 127.7 | 72.3 | 115 |
| Parts by mass | 145 | 60 | 60 | 60 | 60 | 60 |
| Outer layer | | | | | | |
| Outer layer rubber composition | A | A | A | A | A | A |
| Rubber (parts by mass) | | | | | | |
| GECO | 40 | 40 | 40 | 40 | 40 | 40 |
| NBR*1 | 60 | 60 | 60 | 60 | 60 | 60 |
| NBR*2 | — | — | — | — | — | — |
| CR | — | — | — | — | — | — |
| Evaluation | | | | | | |
| Swelling percentage of outer layer (%) | 0.35 | 0.35 | 0.61 | 0.61 | 1.60 | 1.24 |
| Bleeding evaluation I | ○ | ○ | ○ | ○ | x | x |
| Bleeding evaluation II | ○ | ○ | ○ | ○ | x | x |

*1Acrylonitrile content was 33.5%.
*2Acrylonitrile content was 18.0%.

The results for Examples 1 to 7 and Comparative Examples 1 to 4 shown in Tables 5 and 6 indicate that, where the inner layer made of the inner layer elastic material containing the softener (e.g., petroleum-derived oil) and the outer layer made of the outer layer elastic material having a softener swelling percentage of not higher than 1% are combined together, the resulting semiconductive roller is flexible, and substantially free from the contamination of the photoreceptor body and the like and the associated defective image formation which may otherwise occur due to the bleeding of the softener.

The results for Examples 1 to 7 and Comparative Examples 1 to 4 indicate that, in order to control the swelling percentage of the outer layer elastic material to not higher than 1%, it is preferred to use a petroleum-derived oil having a dynamic viscosity of not lower than 10 $mm^2/s$ at 100° C. and an aniline point of not lower than 120° C. and to use a polar rubber including epichlorohydrin rubber such as GECO and NBR having an acrylonitrile content greater than an intermediate level for the outer layer elastic material.

What is claimed is:

1. A semiconductive roller comprising a roller body which comprises:

a tubular inner layer of an inner layer elastic material containing a softener; and an outer layer of an outer layer elastic material provided on an outer periphery of the inner layer, the outer layer elastic material having a swelling percentage of not higher than 1% as measured when the outer layer elastic material is immersed in the softener at 100° C. for 24 hours.

2. The semiconductive roller according to claim 1, wherein the inner layer elastic material is a crosslinked product of an inner layer rubber composition comprising a nonpolar rubber and not less than 15 parts by mass of the softener based on 100 parts by mass of the nonpolar rubber, wherein the outer layer elastic material is a crosslinked product of an outer layer rubber composition comprising a polar rubber.

3. The semiconductive roller according to claim 2, wherein the softener is present in a proportion of not less than 15 parts by mass and not greater than 180 parts by mass based on 100 parts by mass of the nonpolar rubber in the crosslinked product of the inner layer rubber composition.

4. The semiconductive roller according to claim 2, wherein the softener is present in a proportion of not less than 50 parts by mass and not greater than 150 parts by mass based on 100 parts by mass of the nonpolar rubber in the crosslinked product of the inner layer rubber composition.

5. The semiconductive roller according to claim 2, wherein the softener has a dynamic viscosity of not lower than 10 $mm^2/s$ at 100° C.

6. The semiconductive roller according to claim 5, wherein the softener has a dynamic viscosity of not lower than 10 $mm^2/s$ and not higher than 35 $mm^2/s$ at 100° C.

7. The semiconductive roller according to claim 5, wherein the softener is a petroleum-derived oil having an aniline point of not lower than 120° C.

8. The semiconductive roller according to claim 7, wherein the softener is a petroleum-derived oil having an aniline point of not lower than 120° C. and not higher than 150° C.

9. The semiconductive roller according to claim 2, wherein the crosslinked product of the inner layer rubber composition is different in solubility parameter (SP) value from the softener by a difference of less than 1, wherein the crosslinked product of the outer layer rubber composition is different in solubility parameter (SP) value from the softener by a difference of not less than 1.

10. The semiconductive roller according to claim 1, wherein the outer layer has a thickness of not less than 0.1 mm and not greater than 1 mm.

11. The semiconductive roller according to claim 1, which is incorporated as a developing roller in an electrophotographic image forming apparatus.

* * * * *